US006372689B1

(12) United States Patent
Kuga et al.

(10) Patent No.: US 6,372,689 B1
(45) Date of Patent: Apr. 16, 2002

(54) THERMAL TRANSFER IMAGE RECEIVING MATERIAL AND THERMAL TRANSFER RECORDING METHOD USING THE RECEIVING MATERIAL

(75) Inventors: Yutaka Kuga; Hidehiro Mochizuki; Makoto Sekiyama, all of Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/576,561

(22) Filed: May 22, 2000

(30) Foreign Application Priority Data

May 25, 1999 (JP) ..... 11-145165

(51) Int. Cl.[7] ..... B41M 5/035; B41M 5/38

(52) U.S. Cl. ..... 503/227; 156/235; 428/195; 428/206; 428/913; 428/914

(58) Field of Search ..... 8/471; 428/195, 428/206, 913, 914; 503/227; 156/235

(56) References Cited

U.S. PATENT DOCUMENTS

| | | | | |
|---|---|---|---|---|
| 5,071,823 A | * | 12/1991 | Matsushita et al. | 503/227 |
| 5,348,931 A | | 9/1994 | Mochizuki et al. | |
| 5,376,619 A | | 12/1994 | Mochizuki et al. | |
| 5,393,726 A | * | 2/1995 | Graumann | 503/227 |
| 5,525,573 A | | 6/1996 | Uemura et al. | |
| 5,565,404 A | | 10/1996 | Mochizuki et al. | |
| 5,658,850 A | | 8/1997 | Taniguuchi et al. | |
| 5,834,398 A | | 11/1998 | Mochizuki et al. | |
| 5,990,042 A | | 11/1999 | Mochizuki et al. | |

FOREIGN PATENT DOCUMENTS

| | | |
|---|---|---|
| JP | 61197282 | 9/1986 |
| JP | 62269124 | 11/1987 |
| JP | 63 50886 | 3/1988 |
| JP | 63087286 | 4/1988 |
| JP | 1027996 | 1/1989 |
| JP | 01086116 | 3/1989 |
| JP | 9099651 | 4/1997 |
| JP | 10129128 | 5/1998 |
| JP | 10149117 | 6/1998 |
| WO | 9428202 | 12/1994 |
| WO | 9803896 | 1/1998 |

* cited by examiner

*Primary Examiner*—Bruce H. Hess
(74) *Attorney, Agent, or Firm*—Cooper & Dunham LLP

(57) ABSTRACT

A thermal transfer image receiving material including a substrate, an intermediate layer which includes hollow particles and a binder resin and which is formed overlying the substrate, and an image receiving layer which includes a resin and which is formed overlying the intermediate layer and on which an image is to be formed, wherein each of the hollow particles in the intermediate layer has a particle diameter not greater than about 35 $\mu$m.

20 Claims, 4 Drawing Sheets

THERMAL TRANSFER IMAGE RECEIVING MATERIAL AND THERMAL TRANSFER RECORDING METHOD USING THE RECEIVING MATERIAL

BACKGROUND OF THE INVENTION

1. Field of the Invention

The present invention relates to a thermal transfer image receiving material which is used together with a thermal transfer recording material to form images thereon. In addition, the present invention relates to a thermal transfer recording method using the receiving material.

2. Discussion of the Related Art

In thermal transfer recording, imagewise heat is applied to a thermal transfer recording material, such as thermofusible thermal transfer recording materials and sublimation thermal transfer recording materials, whose ink layer contacts a thermal transfer image receiving material, to form an image on the receiving material. The receiving material is broadly classified into film receiving materials having a film substrate and paper receiving materials having a paper substrate. Film receiving materials have a smooth surface. However, when imagewise heat is applied to a thermal transfer recording material contacting a film receiving material to form images on the receiving material, the heat tends to diffuse through the receiving material, resulting in formation of poor images. Namely, the film receiving materials have poor thermosensitivity. In addition, films generally have poor cushion ability (hereinafter referred to as cushionability) Therefore, the adhesion of a film receiving material to the ink layer of a recording material is not good, resulting in formation of images having uneven image density. This is caused by uneven contact of the receiving material with the ink layer.

Paper receiving materials also have poor thermosensitivity. Although paper receiving materials have relatively good cushionability compared to the film receiving materials, the resultant images have uneven image density because the paper receiving materials have rough surface due to uneven distribution of paper fibers in the paper substrate.

In attempting to solve these problems, Japanese Patent Publication No. 6-84119 discloses a receiving material having a combination substrate in which a paper and a synthetic paper are adhered to each other. Japanese Patent Publication No. 8-32487 and Japanese Patent No. 2726040 (Japanese Laid-Open Patent Publication No. 63-87286) have disclosed paper receiving materials in which a receiving layer is formed on a paper substrate with an intermediate layer including foamed particles therebetween. It is described in the documents that the heat insulation property of the receiving materials is improved and therefore the image density of the resultant images is improved.

The receiving materials having a paper/synthetic paper substrate have good heat insulation property and good smoothness, however the materials have drawbacks in that they do not have a feeling of paper and have high manufacturing costs.

The receiving materials having an intermediate layer including foamed particles have good heat insulation property and cushionability, and therefore the thermosensitivity can be improved. However, the surface of the intermediate layer has rough surface because particles are dispersed in the layer. Since the intermediate layer has cushionability, the contact of the ink layer with the image receiving layer is improved to some extent when the recording material and the receiving material are pressed by a thermal head and a platen roller. However, the ink layer of the recording material unevenly contacts the receiving layer of the receiving material when microscopically observed. Therefore, the receiving materials are not suitable for current thermal transfer recording methods in which 128 or 256 levels of halftone images are produced. Japanese Laid-Open Patent Publication No. 9-99651 discloses a receiving material having an intermediate layer including hollow particles which have a weight average particle diameter of from 2 to 7 $\mu$m and in which hollow particles having a particle diameter of from 2 to 6 $\mu$m are present in an amount of not less than 50% by weight. It is described in the publication that by forming such an intermediate layer, the resultant receiving material has good cushionability, heat insulation property and surface smoothness, and therefore the receiving material has a feeling and a gloss like a paper as well as the receiving material can produce good images.

However, even when hollow particles having a particle diameter of from 2 to 6 $\mu$m are present in an amount of not less than 50% by weight in the intermediate layer, the receiving material has a rough surface (i.e., projected portions due to the large particles and recessed portions due to broken large particles) when large particles are present in the layer. When images are formed on such rough portions, white spots tend to occur therein, resulting in deterioration of the images.

In addition, when a large particle is present in the layer, particles tend to adhere to the large particle, resulting in formation of aggregates of particles (i.e., formation of rough portions).

This white spot problem conspicuously occurs when images are formed by an n-fold speed mode multiple thermal recording method in which a receiving material is fed at a speed n (n>1) times that of a recording material while their surfaces are rubbed together in the image forming process. The reason of occurrence of white spots in this process is considered to be that the hollow particles tend to be broken when the receiving material is rubbed with the recording material. This is confirmed by our examination in that when images are recorded with an edge type thermal head whose head pressure is larger than a partial-graze type plane thermal head, white spots (i.e., uneven images) caused by breaking of the hollow particles in the intermediate layer are produced more than in a case using the partial-graze type plane thermal head.

Japanese Laid-Open Patent Publication No. 10-129128 discloses a receiving material in which a thick receiving layer is formed on an intermediate layer having hollow particles such that the rough surface of the intermediate layer does not influence the surface smoothness of the receiving layer.

However, when such a thick receiving layer is formed, the cushionability and heat insulation property of the receiving material deteriorate, resulting in deterioration of image qualities and thermosensitivity. In addition, it takes a long time to prepare such a thick receiving layer because coating must be performed twice or more. Even when the thick layer is coated by one coating operation, it takes a long time to dry the coated liquid. Therefore, a problem which occurs is that manufacturing costs increase.

Because of these reasons, a need exists for thermal transfer receiving material on which images having good image qualities without uneven images can be formed with relatively low heat energy and which has relatively low manufacturing costs.

SUMMARY OF THE INVENTION

Accordingly, an object of the present invention is to provide a thermal transfer receiving material on which images having good image qualities can be formed with low heat energy and which has relatively low manufacturing; costs.

Another object of the present invention is to provide a thermal recording method in which images having good image qualities can be produced on the receiving material with relatively low heat energy at relatively low running costs.

To achieve such objects, the present invention contemplates the provision of a thermal transfer receiving material which includes a substrate, an intermediate layer which includes hollow particles and a binder resin and which is formed overlying the substrate, and a receiving layer which is formed overlying the intermediate layer, wherein each of the hollow particles in the intermediate layer has a particle diameter not greater than about 35 $\mu$m. Each of the hollow particles preferably has a particle diameter not greater than about 30 $\mu$m.

The surface of the intermediate layer preferably has a ten-point mean roughness Rz less than 4.0 $\mu$m. The ten-point mean roughness is measured by a method based on JIS B0601.

In addition, preferably, the average hollow rate of the hollow particles is not less than 50%, and the thickness of the intermediate layer and receiving layer is from 10 to 100 $\mu$m and not greater than 10 $\mu$m, respectively.

In another aspect of the present invention, an n-fold speed mode thermal transfer recording method is provided which includes steps of feeding the receiving material mentioned above, and a thermal transfer recording material having an ink layer on one side thereof; and imagewise heating the recording material from the backside thereof to form an image on the receiving material while the ink layer contacts the receiving material, wherein the receiving material is fed at a speed n (n>1) times the feeding speed of the recording material.

Preferably, the imagewise heating is performed using an edge-type thermal head and a recording material having plural color ink layers to form a color image on the receiving material.

These and other objects, features and advantages of the present invention will become apparent upon consideration of the following description of the preferred embodiments of the present invention taken in conjunction of with the accompanying drawings.

DESCRIPTION OF THE PREFERRED EMBODIMENTS

The receiving material of the present invention is typically used for sublimation thermal transfer recording, but is not limited thereto.

Hereinafter the sublimation thermal transfer receiving material will be explained.

The thermal transfer image receiving material of the present invention includes at least a substrate, an intermediate layer including hollow particles and a-binder resin, and an image receiving layer including a dyeable resin.

Figure 1:
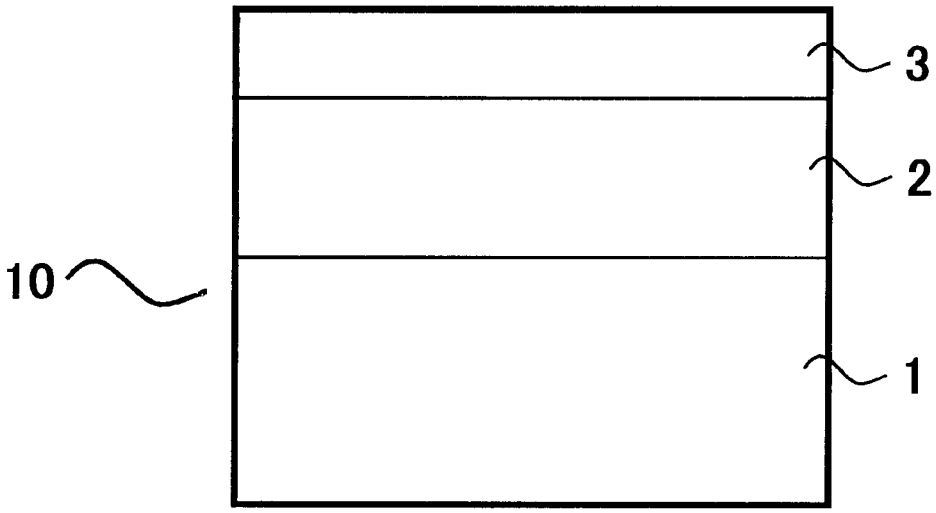
FIG. 1 is a schematic diagram illustrating the cross section of an embodiment of the receiving material of the present invention.

The structure of a typical embodiment of the receiving material of the present invention is illustrated in FIG. 1.

In FIG. 1, a thermal transfer image receiving material 10 has a substrate 1, an intermediate layer 2 which is formed overlying the substrate 1, and an image receiving layer 3 which is formed overlying the intermediate layer.2.

Figure 2:
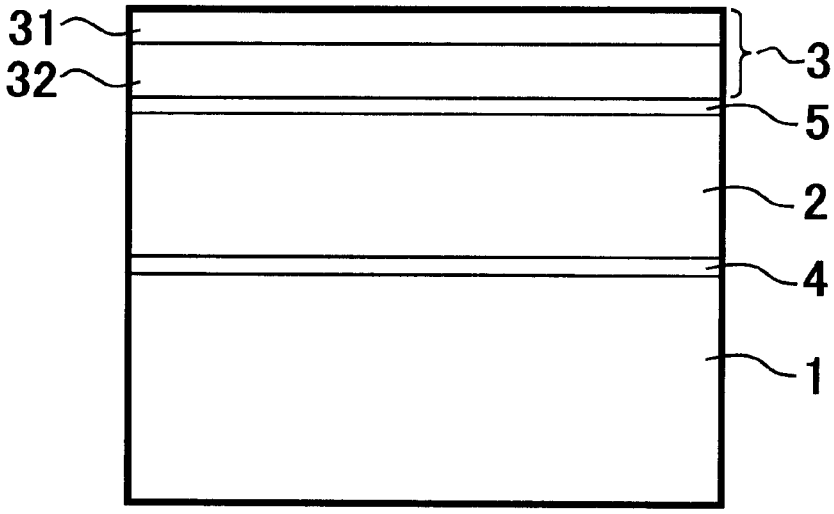
FIG. 2 is a schematic diagram illustrating the cross section of another embodiment of the receiving material of the present invention.

FIG. 2 illustrates another embodiment of the receiving material of the present invention. In FIG. 2, the image receiving layer 3 has a release layer 31 including a releasing agent, and a dye receiving layer 32 which includes a dyeable resin. In addition, a water barrier layer 4 and an organic solvent barrier layer 5 are formed between the substrate 1 and the intermediate layer 2 and between the intermediate layer 2 and the image receiving layer 3, respectively.

The structure of the receiving material of the present invention is not limited thereto. For example, a back layer may be formed on the side of the substrate 1 opposite the side on which the intermediate layer and receiving layer are formed.

Figure 3:
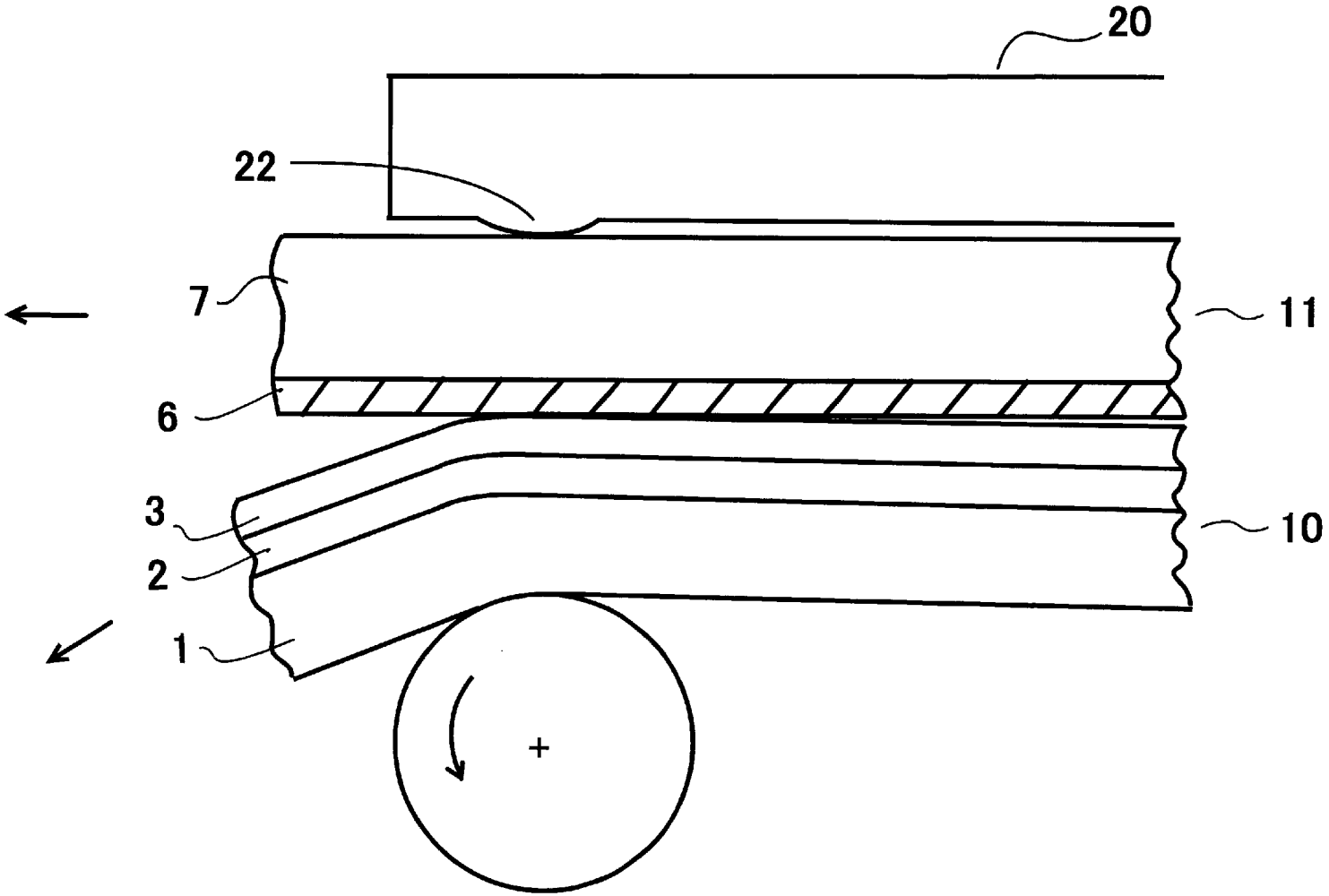
FIG. 3 is a schematic diagram of an image recording portion of a thermal printer useful for the thermal recording method of the present invention.

FIG. 3 is a schematic diagram illustrating an image recording portion of a thermal printer useful for the thermal transfer recording method of the present invention. As shown in FIG. 3, a thermal transfer recording material 11, which has an ink layer 6 formed on a substrate 7, is set on a receiving material 10 such that the ink layer 6 contacts the image receiving layer 3. A plane-type thermal head 20 having partially-grazed heat elements 22 applies imagewise heat to the backside of the recording material, which is the side opposite that bearing the ink layer 6, while the recording material 11 and receiving material 10 are fed in a direction as shown by each arrow. Numeral 21 denotes a platen roller, which rotates in a direction as shown by an arrow. Thus, ink is transferred on the receiving layer, resulting in formation of images.

Each of the hollow particles included in the intermediate layer of the receiving material of the present invention has a particle diameter not greater than about 35 $\mu$m, and preferably not greater than about 30 $\mu$m.

The receiving material of the present invention has good cushionability and heat insulation property. Therefore, the receiving material can produce good images without image defects such as white spots and uneven-density images even when relatively low heat energy is applied to the recording material for recording images.

The cushionability and heat insulation property of the receiving material of the present invention mainly depend on the hollow rate of hollow particles included in the intermediate layer. The hollow rate of a hollow particle is defined as follows:

$$\text{Hollow rate } (\%) = (ID/OD) \times 100$$

wherein ID represents an inside diameter of the hollow particle (i.e., the diameter of hollow) and OD represents an outside diameter of the hollow particle.

The average hollow rate of hollow particles is determined by averaging the hollow rates of the hollow particles.

The hollow particles included in the intermediate layer preferably have an average hollow rate not less than about 50%, more preferably not less than about 70%, and even more preferably not less than about 85%, to obtain good cushionability and heat insulation property. When hollow particles having an average hollow rate less than about 50% are used in the intermediate layer, a large amount of the hollow particles must be included in the intermediate layer, resulting in deterioration of mechanical strength of the intermediate layer.

The hollow particles are materials in which air is typically included in a shell made of a thermoplastic resin. The hollow particles are typically prepared by preparing particles having a thermoplastic resin shell and including a liquid having a low boiling point therein, and heating the particles to evaporate the liquid. The thus prepared hollow particles at first include the gas of the liquid in the hollows, however, the gas is gradually substituted with air. Specific examples of the thermoplastic resins for use as the shell include polystyrene, polyvinyl chloride, polyvinylidene chloride, polyvinyl acetate, polyacrylic acid esters, polyacrylonitrile, polybutadiene, and their copolymers and the like. Among these resins, copolymers mainly constituted of vinylidene chloride and acrylonitrile are preferable.

The volume average particle diameter of the hollow particles is preferably not greater than about 10 μm to prepare a recording material having a smooth surface such that the resultant receiving material has good thermosensitivity and produce good images without white spots. It is preferable to use hollow particles in which the scatter in the particle diameter of the particles is small, i.e., whose particle diameter is uniform.

Namely, when the receiving material has good heat insulation property, the heat energy supplied to a recording material can be effectively used for printing images because the heat tends not to be diffused through the substrate of the receiving material. Therefore the images can be formed on the receiving material with a relatively low heat energy.

The thickness of the intermediate layer is preferably from about 10 μm to about 100 μm, and preferably from about 40 μm to about 90 μm, to obtain good cushionability and heat insulation property and to avoid curling of the receiving material.

The intermediate layer of the present invention including hollow particles is not a layer prepared by the following method:

(1) preparing a layer including foamable particles in which a volatile liquid is microencapsulated with a resin shell; and (2) heating the layer to foam the particles in the layer.

The particle diameter of the foamed particles cannot be controlled. Therefore, such layer cannot be used as the intermediate layer of the present invention.

The thickness of the receiving layer is preferably from about 0.5 μm to about 10 μm, and more preferably from about 2 μm to about 5 μm to obtain good images which have high image density and which do not produce image defects such as white spots. In addition, when the receiving layer is too thin, a problem which occurs is that a dye image crystallizes during preservation, resulting in bleeding of the dye. On the contrary, when the receiving layer is too thick, the cushionability and heat insulation property deteriorate, resulting in decrease of thermosensitivity of the receiving material. In addition, it is hard to form such a thick receiving layer at a time by a conventional coating method such as wire bar coating and gravure coating, and therefore two or more coating processes are needed, resulting in deterioration of productivity of the receiving material.

When the image receiving layer has a thickness in the above-mentioned range, the problems such as occurrence of white spots and uneven-density images cannot be necessarily solved by the method described in Japanese Laid-Open Patent Publication No. 9-99651, i.e., by using hollow particles having a weight average particle diameter of from 2 to 7 μm and including particles having a particle diameter of from 2 to 6 μm in an amount of not less than 50%. The present inventors discover that the problems can be solved by removing large hollow particles having a particle diameter not less than about 35 μm from the intermediate layer. It is preferable that there are no large particles having a particle diameter not less than about 30 μm.

In order to prepare hollow particles in which particles having a particle diameter not less than 35 μm are not present, the following methods can be used:

(1) preparing hollow particles having a relatively small volume average particle diameter (for example, not greater than 10 μm, preferably not greater than 7 μm and more preferably not greater than 4 μm) while keeping the average hollow rate of the hollow particles not less than 50%; and (2) preparing hollow particles whose particle diameter distribution has a relatively small standard deviation.

In both methods, the prepared hollow particles are preferably classified by filtering or the like such that the hollow particles do not include large particles having a particle diameter greater than about 35 μm, and preferably the hollow particles do not include large particles having a particle diameter greater than 30 μm. In the present invention, the method (1) is preferably used.

By using the hollow particles in which particles having a particle diameter not less than about 35 μm are not present, the resultant receiving material has a smooth surface even when a receiving layer having a relatively thin thickness of from 1 to 10 μm is formed thereon, and therefore images having good evenness can be obtained.

Ten-point mean roughness Rz of the surface of the receiving material on which images are to be formed is preferably less than 4.0 μm when measured by a method based on JIS B0601. In the present invention, the ten-point mean roughness Rz is measured using a surface analyzer, SURFCODER SE-30K, and an analyzer, SURFCODER ANALYZER AY-41, both of which are manufactured by Kosaka Laboratory Ltd.

In addition, in order to further improve the thermosensitivity of the receiving material and image qualities such as evenness of the images formed on the receiving material, the gloss Gs(60°) of the surface of the receiving material is preferably not less than about 40%. The thickness of the receiving layer should be controlled so that the gloss of the surface of the resultant receiving material is in the preferable range mentioned above. The gloss Gs(60°) can be measured by a method based on JIS Z-8741. In the present invention, the gloss is measured using a gloss meter, HANDY GLOSS-METER PG-1M manufactured by NIPPON DENSHOKU CO., LTD.

In order to prepare a receiving material having a smooth surface, the receiving material is preferably subjected to a calender treatment when the receiving material is manufactured. The calender treatment is performed preferably after the intermediate layer is formed or the receiving layer is formed. The pressure in the calender treatment is 1 to 150 mPa, and preferably from 5 to 100 mPa, not to damage the intermediate layer (i.e., not to break the hollow particles). In addition, the temperature of the rollers of calender machines is preferably from room temperature to the glass transition temperature Tg of the binder resin included in the intermediate layer. Specifically the temperature is from 30 to 150° C. and preferably from 40 to 130° C.

The content of the hollow particles in the intermediate layer (i.e., the ratio of the weight of the hollow particles to the total weight of the intermediate layer) is from 0.1 to 0.9 and preferably from 0.25 to 0.7. The content of the hollow particles in the intermediate layer should be controlled so that the resultant intermediate layer has a combination of good mechanical strength, cushionability and heat insulation property.

When the intermediate layer, which is relatively thick, is formed by coating a coating liquid and then drying the coated liquid, cracks tend to be formed in the resultant intermediate layer if the content of the hollow particles is relatively high. In order to avoid the formation of the cracks, the content of the hollow particles in the intermediate layer is preferably not greater than about 0.6. Therefore, the content of the hollow particles is preferably from about 0.25 to about 0.6.

The heat conductivity of the intermediate layer is preferably not greater than 0.0561 W/mK so that the receiving material has good thermosensitivity.

In general, hollow particles have a small specific gravity. Therefore, the hollow particles tend to be present in an upper portion of a coating liquid, resulting in formation of an intermediate layer in which the hollow particles are unevenly dispersed. Accordingly, hollow particles treated with an inorganic pigment are preferably used to prevent this problem. Specific examples of such an inorganic pigment include calcium carbonate, talc, titanium oxide and the like pigments. The pigment is adhered to the hollow particles while heating a mixture of the hollow particles and the pigment. By heating the hollow particles, the shell of the hollow particles softens and the pigment can adhere to the shell of the hollow particles.

When the receiving material of the present invention is used for color image recording, the receiving material is needed to have high whiteness. The whiteness is preferably from −2 to −7 in the parameter b in (L, a, b) chromaticity coordinates. When the whiteness of the receiving material is not in the range because of the hollow particles have poor whiteness, it is preferable to include a fluorescent brightening agent in the shell resin of the hollow particles and/or in the intermediate layer.

When the intermediate layer is formed, both an organic solvent type coating liquid or an aqueous coating liquid can be used. However, it is preferable to use an aqueous coating liquid when it is taken into consideration that the solvent resistance of hollow particles is not good. Among aqueous coating liquids, coating liquids including a resin such as polyvinyl alcohols, cellulose resins and their derivatives are preferably used because of having good film formability, heat resistance and flexibility.

When a relatively thick intermediate layer is formed, coating liquid having a high solid content and a low viscosity are preferably used. When an aqueous coating liquid having a low solid content is used, problems tend to occur in that the resultant receiving material is waved, the surface of the intermediate layer is roughened, and/or cracks are formed in the intermediate layer. From this viewpoint, coating liquid including a resin emulsion are preferably used.

However, when only a resin emulsion is used as a binder resin in an intermediate layer coating liquid, the hollow particles cannot be protected by the binder resin in the coating liquid. Therefore, the hollow particles tend to separate in the coating liquid, resulting in uneven distribution of the hollow particles in the intermediate layer. In order to avoid this problem, a water-soluble resin is preferably included in the coating liquid to protect the hollow particles and to control the viscosity of the coating liquid. Therefore, a liquid which mainly includes a resin emulsion and to which a water-soluble resin is added in a relatively small amount compared to the emulsion resin is preferable for the intermediate layer coating liquid.

The solid content of the intermediate layer coating liquid is not less than 10% by weight and preferably not less than 20% by weight.

As shown in FIG. 2, a water barrier layer 4 may be formed between the intermediate layer 2 and the substrate 1 to prevent the intermediate layer coating liquid from penetrating into the substrate 1. The water barrier layer 4 mainly includes a resin which does not dissolve in water.

When an image receiving layer coating liquid including organic solvent is coated on the intermediate layer to form the image receiving layer 3, an organic solvent barrier layer 5 is preferably formed on the intermediate layer 2 as shown in FIG. 2 because hollow particles tend to be damaged by organic solvents. By forming an organic solvent barrier layer 5, the intermediate layer 2 can maintain good cushionability and heat insulation property.

The intermediate layer can be formed by a known coating method such as roll coating, bar coating, gravure coating, gravure reverse coating and die coating. Among these coating methods, bar coating and die coating are preferably used because a uniform thick layer can be formed at a relatively high speed.

Suitable resins for use as the binder resin in the intermediate layer include known thermoplastic and thermosetting resins. Specific examples of such resins include vinyl acetate resins, polyester resins, polyvinyl chloride resins, vinyl chloride-vinyl acetate copolymers, cellulose ester resins, epoxy resins, polyvinyl butyral resins, polyurethane resins, polyacrylate resins, polymethacrylate resins, polycarbonate resins, polyvinyl alcohol resins, polystyrene resins, polyetherimide resins, polyamide resins, polyethylene oxide resins, polyvinyl ether resins, polyacrylonitrile resins and the like resins.

These resins can be used alone or in combination. In addition, a crosslinking agent may be added to the coating liquid to form a crosslinked layer.

From the viewpoint that the receiving material preferably has good heat resistance, heat resistant resins or crosslinked resins are preferably used as the binder resin. In addition, the binder resin preferably has good solvent resistance to prevent the hollow particles from being damaged when a solvent type coating liquid is coated thereon to form the image receiving layer.

Therefore, among the resins mentioned above, the following resins are preferably used:

Cellulose derivatives such as methyl cellulose, hydroxyethyl cellulose, hydroxypropyl cellulose, hydroxypropylmethyl cellulose, hydroxybutylmethyl cellulose, carboxymethyl cellulose and the like; alginic acid, starch and their derivatives; polyvinyl alcohol and its derivatives; water-soluble resins such as polyacrylic acid, maleic acid based resins, casein, shellac, glue and the like; and other resins such as polyacrylates, ethylene-vinyl acetate copolymers, polyethylene including a carboxyl group and the like resins. Among these resins, polyvinyl alcohol and its derivatives are preferable because of having good binding ability and good solvent resistance.

Polyvinyl alcohol and its derivatives are preferably crosslinked with a crosslinking agent such as dimethylol urea, trimethylol melamine, and glyoxal to improve water resistance.

Suitable substrates for use in the receiving material of the present invention include films such as polyolefin films, polyvinyl chloride films, polyethylene terephthalate films, polystyrene films, polymethacrylate films, and polycarbonate films; papers such as paper, cast-coated paper, coated paper, baryta paper, RC paper, art paper, and synthetic paper; and complex sheets such as polyolefin-coated paper, and laminated sheets of paper with a film such as polyolefin, polyvinyl chloride, polyethylene terephthalate, polystyrene, polymethacrylate, and polycarbonate. In addition, white opaque films in which one or more white pigments and fillers are included in resin films, or porous resin films can be employed as the substrate. In addition, paper sheets on which a resin is coated can also be used.

The thickness of the substrate is generally from about 10 to about 300 $\mu$m. The substrate may be subjected to primer coating and/or corona charging treatment.

The image receiving layer mainly include a dyeable resin.

Suitable dyeable resin for use in the receiving layer include known resins which are dyed with sublimable dyes. Specific examples of such resins include known thermoplastic and thermosetting resins such as polyvinyl acetate resins, polyester resins, polyvinyl chloride resins, vinyl chloride-vinyl acetate copolymers, cellulose ester resins, epoxy resins, polyvinyl butyral resins, polyurethane resins, polyacrylate resins, polymethacrylate resins, polycarbonate resins, polyvinyl alcohol resins, polystyrene resins, polyetherimide resins, polyamide resins, polyethylene oxide resins, polyvinyl ether resins, polyacrylonitrile resins and the like resins. Among these resins, polyvinyl acetal resins are preferable because images having good image density can be formed on the resultant receiving material and the images have good preservation property.

The thickness of the image receiving layer is preferably from about 1 $\mu$m to about 20 $\mu$m, and more preferably from about 1 $\mu$m to about 10 $\mu$m.

The image receiving layer may include auxiliary agents such as lubricants (e.g., modified or unmodified silicone oils and fluorine-containing compounds); fillers (e.g., titanium oxide, zinc oxide, calcium carbonate, and silica); surfactants; ultraviolet absorbents; antioxidants; and fluorescent brightening agents.

In the present invention, the image receiving layer 3 may include a release layer 31 and a dye receiving layer 32 as shown in FIG. 2.

The release layer 31 is formed to avoid a sticking problem in that the receiving layer of the receiving material adheres to the ink layer of a recording material when images are recorded. The sticking problem tends to occur when an n-fold speed mode multiple thermal transfer recording method is used for forming images. The n-fold speed mode multiple thermal transfer recording method will be explained later. The release layer 31 mainly includes a resin having releasability. Suitable resins having releasability for use in the release layer 31 include silicone resins. In addition, lubricants can be added to the release layer 31. Specific examples of such lubricants include petroleum lubricants such as liquid paraffins; synthetic lubricants such as halogenated hydrocarbons, diester oils, silicone oils, and fluorine-containing silicone oils; modified silicone oils such as epoxy-modified, amino-modified, alkyl-modified, and polyether-modified silicone oils; silicone lubricants or silicone copolymers such as copolymers of polyoxyalkylene glycol with silicone; fluorine-containing surfactants such as fluoroalkyl compounds; fluorine-containing surfactants such as fluoroalkyl compounds; waxes such as paraffin waxes, and polyethylene waxes; higher aliphatic alcohols, higher fatty acid amides, higher fatty acid esters, higher fatty acid salts, molybdenum disulfide, and the like. These lubricants can be used alone or in combination.

Among these compounds, silicone copolymers in which silicone segments are incorporated to a resin by a block or graft polymerization method are preferable.

The release layer 31 may include auxiliary agents such as ultraviolet absorbents; antioxidants; and photostabilizers.

The thickness of the release layer 31 is preferably from about 0.05 $\mu$m to about 10 $\mu$m.

The release layer 31 may be subjected to a heat treatment after dye images are recorded thereon. By heating the release layer 31 having dye images thereon, the dye images are diffused into the receiving layer (i.e., into the release layer and dye receiving layer), resulting in improvement of light resistance of the images. The heat treatment can be performed once or more than twice.

The heat treatment can be performed with a thermal printhead. Suitable heating in the heat treatment with a thermal printhead is to heat the entire surface of dye images by applying heat energy not greater than the heat energy which can record images having maximum image density. The receiving material may be heated with a thermal printhead by heating from the back side of the recording material which includes a layer having no ink (no dye), i.e., heating from the back side of a no-ink area of the recording material.

The dye receiving layer 32 mainly includes a resin which is dyeable.

Suitable materials for use in the dye receiving layer include known resins which are dyed with sublimable dyes. Specific examples of such resins include known thermoplastic and thermosetting resins mentioned above for use in the receiving layer.

The image receiving material of the present invention can be used for one-time recording in which images are formed on a receiving material using a recording material only one time, or for multiple recording in which images are formed on a receiving material using an ink layer of a receiving material several times or by an n-fold speed mode multiple recording.

The thickness of the dye receiving layer is preferably from 1 to 20 $\mu$m, and more preferably from 1 to 10 $\mu$m.

Multiple sublimation thermal transfer recording methods are classified as follows:

(1) a recording method in which an image is formed on a receiving material using a one-time recording method but the recording material is repeatedly used n-times (hereinafter referred to as an n-time mode multiple recording method); and (2) a recording method in which an image is formed on a receiving material while the recording material is fed at a speed of 1/n (n>1) that of the receiving material (hereinafter referred to as an n-fold speed mode multiple recording method).

The image recorded by the n-fold speed mode multiple sublimation thermal transfer recording method is superior to the image recorded by the n-time mode multiple sublimation thermal transfer recording method because of having advantages in that the recorded images have good evenness and the recording material hardly generates wrinkles during the image recording process.

In the present invention, images are preferably formed on the receiving material by a multiple sublimation thermal recording methods to save running cost of recorded images.

Figure 4:
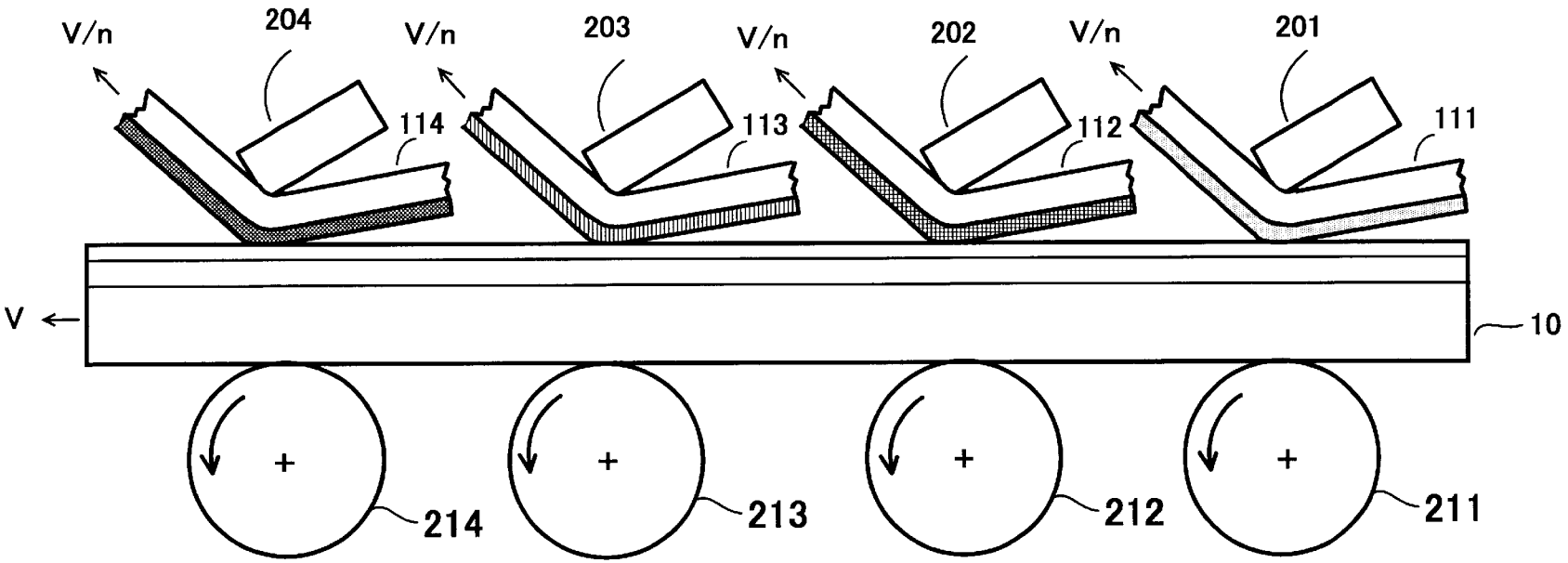
FIG. 4 is a schematic diagram of an image recording portion of another thermal printer useful for the thermal recording method of the present invention.

FIG. 4 is a schematic diagram of a thermal color printer useful for the thermal transfer recording method of the present invention.

In FIG. 4, numerals 111, 112, 113 and 114 denote sublimation thermal transfer recording materials having a yellow ink layer, magenta ink layer, cyan ink layer and black ink layer, respectively. Numerals 201, 202, 203 and 204 denote edge-type thermal heads having heat elements on an edge thereof. Numerals 211, 212, 213 and 214 denote platen rollers. The receiving material 10 is fed at a speed V in a direction as shown by an arrow. Each of the recording materials is also fed at a speed V/n (n>1) in a direction as shown in the respective arrow. The feeding speed of the recording materials may be different. Color images are formed on a desired portion of the receiving material 10 by heating the recording materials 111 to 114 with the thermal heads 201 to 214.

Figure 5:
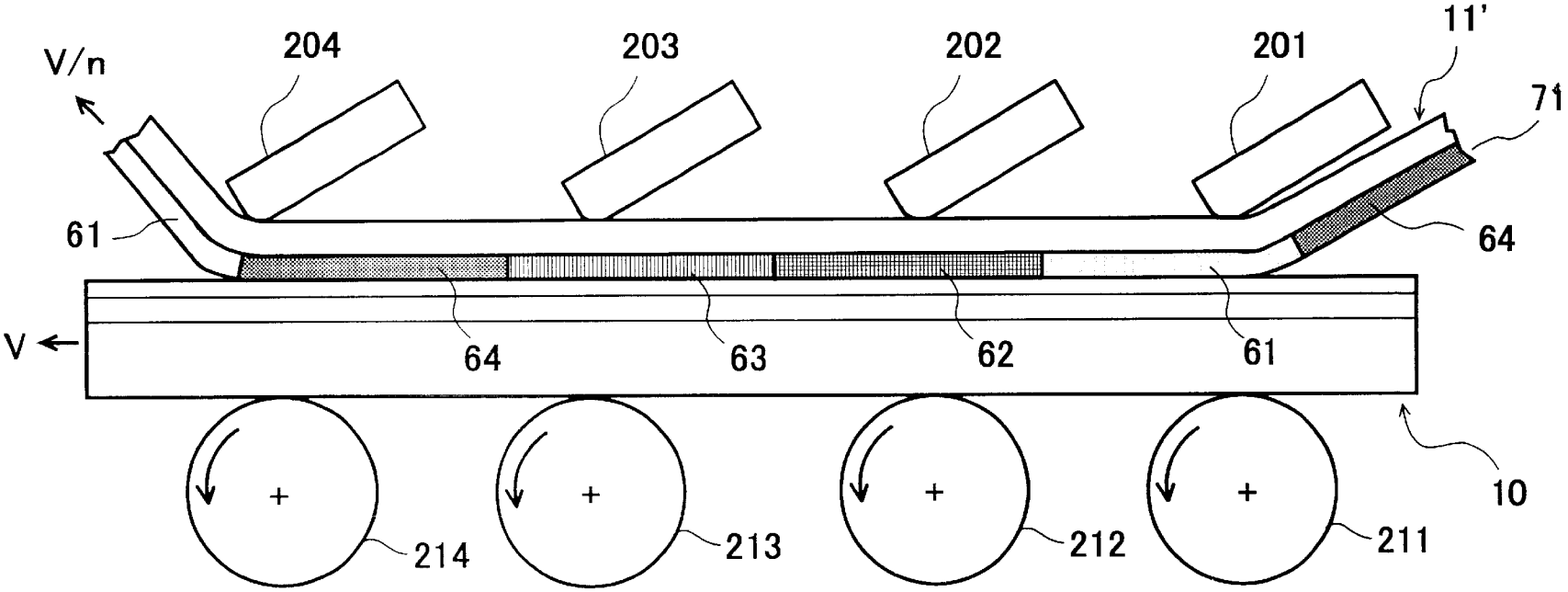
FIG. 5 is a schematic diagram of an image recording portion of yet another thermal printer useful for the thermal recording method of the present invention.

FIG. 5 is a schematic diagram of an image recording portion of another thermal printer useful for the thermal transfer recording method of the present invention.

In FIG. 5, numeral 11' denotes a thermal transfer recording material in which four different color ink layers 61, 62, 63 and 64 (for example, yellow, magenta, cyan and black ink layers) are formed side by side on a substrate 71. An image receiving material is fed by platen rollers 211, 212, 213 and 214 in a direction as shown by an arrow. A color image is formed on a receiving material by heating the backside of the recording material with edge-type thermal heads 201, 202, 203 and 204 while the recording material is fed at a speed of V/n in a direction as shown by an arrow and the receiving material is fed at a speed of V.

When this type of recording material is used, a color image can also be formed on the receiving material using a printer having a thermal head and a platen roller. At first a first color image is transferred on the receiving material by an ink layer with the thermal head. Then this recording operation is repeated more three times while the receiving material rotates on the platen roller or the receiving material is fed back before each recording operation. Thus, a full color image can be formed on the receiving material.

Next, the thermal transfer recording material for use in the present invention will be explained.

The recording material for use in the present invention may be a thermofusible thermal transfer recording material and a sublimation thermal transfer recording material. However, sublimation thermal transfer recording material is preferably used because the produced images have good image qualities.

Hereinafter, the sublimation thermal transfer recording material (hereinafter referred to as recording material) will be explained.

The recording material has a substrate and an ink layer or layers which are formed on one side of the substrate and each of which includes at least a sublimable dye.

Suitable substrates for use in the recording material of the present invention include films of resins such as polyester resins, polysulfone resins, polystyrene resins, polycarbonate resins, cellophane, polyamide resins, polyimide resins, polyarylate resins, and polyethylene naphthalate resins. The thickness of the substrate is preferably from about 0.5 to about 20 $\mu$m, and more preferably from about 3 to about 10 $\mu$m. The substrate may have a heat resistant layer on the side of the substrate opposite that bearing the ink layer, and an undercoat layer which is formed between the ink layer and the substrate and which improves the adhesion of the substrate and the ink layer. The substrate may be subjected to a corona charge treatment.

Specific examples of the sublimable dyes for use in the ink layer include but are not limited to:

C.I. Disperse Yellows 1, 3, 8, 9, 16, 41, 54, 60, 77 and 116;
C.I. Disperse Reds 1, 4, 6, 11, 15, 17, 55, 59, 60, 73 and 83;
C.I. Disperse Blues 3, 14, 19, 26, 56, 60, 64, 72, 99 and 108;
C.I. Solvent Yellows 77 and 116;
C.I. Solvent Reds 23, 25 and 27; and
C.I. Solvent Blues 36, 63, 83 and 105.

These sublimable dyes are employed alone or in combination. Suitable binder resins for use in the ink layer of the recording material of the present invention include thermoplastic resins such as polyvinyl chloride resins, polyamide resins, polycarbonate resins, polystyrene resins, acrylic resins, phenolic resins, polyester resins, epoxy resins, fluorine-containing resins, polyvinyl acetal resins and cellulose resins. These resins are employed alone or in combination. In addition, copolymers of these polymers may be used. Among these resins, cellulose resins and polyvinyl acetal resins are preferable because of having good solubility in organic solvents, which are used for ink layer coating liquids, and good adhesion to the substrate of the recording material. More preferably, polyvinyl acetal resins such as polyvinyl acetoacetal and polyvinyl butyral are used as a binder resin of the ink layer.

Suitable solvents for use in the ink layer coating liquid, which can dissolve or disperse the above-mentioned sublimable dye and the binder resin, include known solvents such as alcohol type solvents, e.g., methanol, ethanol, isopropyl alcohol, butanol and isobutanol; ketone type solvents such as methyl ethyl ketone, methyl isobutyl ketone and cyclohexanone; aromatic solvents such as toluene and xylene; halogen-containing solvents such as dichloromethane and trichloroethane; dioxane; tetrahydrofuran; formamide; dimethylformamide; and dimethylsulfoxide. These solvents are employed alone or in combination. The solvents for use in the ink layer coating liquid are generally selected so as to dissolve or disperse the sublimable dye and the binder resin employed for the ink layer in a desired solid content.

The ink layer of the recording material may be a single layer type or multi-layer type ink layer. The ink layer is typically coated by gravure coating. When an ink layer is unevenly formed by gravure coating, two-layer coating, i.e., two-time coating, is preferably performed. In this case, the lower layer preferably has a higher dye content and/or a larger dye diffusion coefficient than does the upper layer because the resultant recording materials, which are useful for one-time recording, have good preservability and high thermosensitivity, and the resultant recording materials useful for multiple recording can maintain good image qualities when repeatedly used many times.

The ink layer of the recording material for use in n-fold speed mode multiple recording preferably includes a lower ink layer (referred to as a dye supplying layer) and an upper ink layer (referred to as a dye transferring layer). A "lower" layer is closer to the substrate than an "upper" layer. The dye supplying layer preferably includes precipitated sublimable dye particles to obtain good evenness of the image density of the recorded images. The term "precipitated particles" means sublimable dye particles which are precipitated out of a coated dye supplying layer coating liquid, which includes a binder resin, a sublimable dye and a solvent, during a drying step. Therefore, the amount and the particle size of the precipitated dye particles change mainly depending on the solvent used. Presence of the precipitated sublimable dye particles in a dye supplying layer can be easily observed by an electron microscope. The particle size of the sublimable dye particle (which depends on the thickness of the dye supplying layer) is about 0.01 to about 20 μm, and preferably from about 1 to about 5 μm. Since the sublimable dye in the ink layer is particulate, such a problem as crystallization of the sublimable dye does not occur during preservation of the recording material.

To form an ink layer including sublimable dye particles, a solvent which dissolves the sublimable dye particles as little as possible is preferably included in the ink layer coating liquid. Specific examples of such a solvent include alcohol type solvents and solvents including a hydroxide group such as glycol ethers.

In addition, the ink layer preferably includes an upper layer, i.e., a dye transferring layer, which is disclosed, for example, in Japanese Laid-Open Patent Publication No. 5-64980, and which is formed on the dye supplying layer.

In a recording material, the dye transferability of the dye supplying layer is preferably better than that of the dye transferring layer. The dye transferability is determined as follows:

(1) the dye supplying layer and the dye transferring layer are separately formed on a substrate useful for recording materials such that the thickness of each layer is the same;

(2) the substrate is heated from the backside to transfer the dye in the dye supplying layer and the dye transferring layer to a receiving material; and (3) the quantities of the dye transferred from the dye supplying layer to the receiving material and the dye transferred from the dye transferring layer to the receiving material are determined, for example, by measuring the color density.

If the dye supplying layer transfers the dye in an amount of more than the dye transferring layer, the dye supplying layer has better dye transferability than the dye transferring layer.

According to our investigation, the quantity of a diffused dye in an ink layer can be represented by the following Fick's law:

$$dn=-D\cdot(dc/dx)\cdot q\cdot dt$$

wherein dn represents the quantity of dye diffused during time dt, q represents the cross section into which the dye quantity diffuses, (dc/dx) represents the gradient of the diffused dye concentration, and D represents the average diffusion coefficient in the ink layer when heat is applied.

It will be understood from the above-mentioned equation that the ways to effectively supply a dye from a dye supplying layer to a dye transferring layer are as follows:

(1) the dye concentration in the dye supplying layer is higher than that in the dye transferring layer; and/or (2) the diffusion coefficient of the dye supplying layer is greater than that of the dye transferring layer.

Suitable binder resins for use in the dye transferring layer include known thermoplastic resins and thermosetting resins. Specific examples of such resins include polyvinyl chloride resins, polyvinyl acetate resins, polyamide resins, polyethylene resins, polycarbonate resins, polypropylene resins, acrylic resins, polyester resins, polyurethane resins, epoxy resins, silicone resins, fluorine-containing resins, polyvinyl acetal resins, polyvinyl alcohol resins, cellulose resins, natural rubbers, synthetic rubbers and copolymers thereof. These resins are employed alone or in combination.

In order to make the dye transferring layer strongly adhere to the dye supplying layer, the dye transferring layer preferably includes a binder resin which has good compatibility with the binder resin in the dye supplying layer. More preferably, the dye transferring layer preferably includes a binder resin which is the same type of resin as the binder resin included in the dye supplying layer.

When the binder resin in the dye transferring layer has active hydrogen, the binder resin can be reacted with an isocyanate compound to impart good heat resistance to the dye transferring layer, and thereby an image having good evenness can be obtained without occurrence of a sticking problem.

The ink layer preferably includes a resin layer having relatively low dye receivability (hereinafter referred to as low-dyeable layer) on the top of the ink layer to avoid occurrence of a ghost image when two or more color images are recorded one by one on the same area of a receiving material to obtain a full color image. Suitable resins (for use in the low-dyeable layer include aromatic polyester resins, styrene-butadiene copolymers, polyvinyl acetate resins and polyamide resins, methacrylic resins and copolymers thereof, styrene-maleic acid ester copolymers, polyimide resins, silicone resins, styrene-acrylonitrile copolymers and polysulfone resins. Among these resins, methacrylic resins and copolymers thereof, styrene-maleic acid ester copolymers, polyimide resins, silicone resins, styrene-acrylonitrile copolymers and polysulfone resins are preferable. The thickness of the low-dyeable layer is about equal to that of the dye transferring layer. The low-dyeable layer, the dye transferring layer and the dye supplying layer may include known additives such as releasing agents, antioxidants and the like.

Having generally described this invention, further understanding can be obtained by reference to certain specific examples which are provided herein for the purpose of illustrating only and are not intended to be limiting. In the descriptions in the following examples, the numbers represent weight ratios in parts, unless otherwise specified.

EXAMPLES

At first, receiving materials for one-time recording were prepared.

Example 1

Preparation of Intermediate Layer

The following components were mixed and dispersed to prepare an intermediate layer coating liquid. At this point, the physical properties of hollow particles A are shown in Table 1. In addition, hollow particles A had been filtered using a metal sieve having openings of 34 μm before used for the intermediate layer coating liquid. Namely, the maximum particle diameter of hollow particles A used for the coating liquid was 34 μm.

| Formulation of intermediate layer coating liquid | |
|---|---|
| Hollow particles dispersion A (shell of the hollow particles mainly includes a vinylidene chloride-acrylonitrile copolymer) | 28.6 |
| Styrene-butadiene latex (Tradenamed as 0696 manufactured by Japan synthetic Rubber Co., Ltd.) | 33.3 |
| Water | 38.1 |

The intermediate layer coating liquid was coated on a paper sheet having a weight of 157 g/m$^2$ (Tradenamed as OK Top Coat Paper manufactured by Oji Paper Co., Ltd.)

with a wire bar whose wire has a diameter of 1.0 mm, and dried for 3 minutes to form an intermediate layer having a thickness of 30 μm.

Formation of Image Receiving Layer

The following components were mixed such that the resin dissolved in the mixture solvent.

| Formulation of image receiving layer coating liquid | |
|---|---|
| Vinyl chloride-vinyl acetate copolymer (Tradenamed as VYHH manufactured by Union Carbide Corp.) | 10 |
| Amino-modified silicone (Tradenamed as SF8417 manufactured by Toray Silicone Industries Inc.) | 0.1 |
| Toluene | 25 |
| Methyl ethyl ketone | 65 |

Thus, an image receiving layer coating liquid was prepared.

The image receiving layer coating liquid was coated on the intermediate layer with a wire bar, and dried to form an image receiving layer having a thickness of 3 μm.

Thus, an image receiving material of Example 1 useful for one-time sublimation thermal transfer recording was prepared.

Example 2

The procedure for preparation of the image receiving material of Example 1 was repeated except that the formulation of the intermediate layer coating liquid was changed to the following formulation:

| Formulation of intermediate layer coating liquid | |
|---|---|
| Hollow particles dispersion B (shell of the hollow particles mainly includes a vinylidene chloride-acrylonitrile copolymer) | 37.0 |
| Styrene-butadiene latex (Tradenamed as 0696 manufactured by Japan Synthetic Rubber Co., Ltd.) | 33.3 |
| Water | 29.7 |

The physical properties of hollow particles B are also shown in Table 1. Hollow particles B had also been filtered by the metal sieve having openings of 32 μm before used for the intermediate layer coating liquid. Namely, the maximum particle diameter of hollow particles B used for the coating liquid was 32 μm.

Thus, an image receiving material of Example 2 useful for one-time sublimation thermal transfer recording was prepared.

Example 3

The procedure for preparation of the image receiving material of Example 1 was repeated except that the formulation of the intermediate layer coating liquid was changed to the following formulation:

| Formulation of intermediate layer coating liquid | |
|---|---|
| Hollow particles dispersion C (shell of the hollow particles mainly includes a vinylidene chloride-acrylonitrile copolymer) | 33.5 |
| Styrene-butadiene latex (Tradenamed as 0696 manufactured by Japan Synthetic Rubber Co., Ltd.) | 33.3 |
| Water | 33.2 |

The physical properties of hollow particles C are also shown in Table 1. Hollow particles C had also been filtered by the metal sieve having openings of 28 μm before used for the intermediate layer coating liquid. Namely, the maximum particle diameter of hollow particles C used for the coating liquid was 28 μm.

Thus, an image receiving material of Example 3 useful for one-time sublimation thermal transfer recording was prepared.

Example 4

The procedure for preparation of the image receiving material of Example 1 was repeated except that the formulation of the intermediate layer coating liquid was changed to the following formulation:

| Formulation of intermediate layer coating liquid | |
|---|---|
| Hollow particles dispersion D (shell of the hollow particles mainly includes a vinylidene chloride-acrylonitrile copolymer) | 19.5 |
| Styrene-butadiene latex (Tradenamed as 0696 manufactured by Japan Synthetic Rubber Co., Ltd.) | 33.3 |
| Water | 47.2 |

The physical properties of hollow particles D are also shown in Table 1. Hollow particles D had also been filtered by the metal sieve having openings of 26 μm before used for the intermediate layer coating liquid. Namely, the maximum particle diameter of hollow particles D used for the coating liquid was 26 μm.

Thus, an image receiving material of Example 4 useful for one-time sublimation thermal transfer recording was prepared.

TABLE 1

| Hollow particles | Volume average particle diameter (μm) | Solid content (%) | Average hollow rate (%) | Maximum particle diameter (μm) After filtration | Maximum particle diameter (μm) Without filtration |
|---|---|---|---|---|---|
| A | 12.6 | 28.0 | 94.0 | 34 | >35 |
| B | 7.3 | 21.6 | 94.7 | 32 | >38 |
| C | 4.4 | 23.9 | 89.1 | 28 | >50 |
| D | 3.3 | 41.0 | 90.0 | 26 | >45 |

Comparative Examples 1 to 4

The procedure of preparation of the image receiving material of Example 1, 2, 3 or 4 was repeated to prepare except that hollow particles A, B, C or D had not been filtered. Therefore the coating liquids included large hollow particles. The maximum diameter of the hollow particles are shown in Table 1.

Thus, image receiving materials of Comparative Examples 1 to 4 for one-time sublimation thermal transfer recording were prepared.

Preparation of One-time Sublimation Thermal Transfer Recording Material

The following components were mixed such that the polyvinyl butyral resin was dissolved in the mixture solvent.

| Formulation of ink layer coating liquid | |
|---|---|
| Polyvinyl butyral (Tradenamed as BX-1 manufactured by Sekisui Chemical Co., Ltd.) | 2 |
| Cyan dye (Tradenamed as HSB-2207 manufactured by Mitsubishi Chemical Corp.) | 2 |
| Toluene | 49 |
| Methyl ethyl ketone | 49 |

Thus an ink layer coating liquid was prepared.

The ink layer-coating liquid was coated on one side of a polyethylene terephthalate film having a thickness of 6 μm, and dried to form an ink layer of about 2 μm thick. At this point, on the other side of the polyethylene terephthalate film, a backcoat layer having a thickness of 1 μm and consisting of a crosslinked silicone resin had been formed.

Thus, a recording material for one-time sublimation thermal transfer recording was prepared.

Then, receiving materials for n-fold speed mode multiple sublimation thermal transfer recording were prepared.

Example 5

Preparation of Intermediate Layer

The following components were mixed and dispersed to prepare an intermediate layer coating liquid (2). At this point, the physical properties of hollow particles A. In addition, hollow particles A had been filtered using a metal sieve having openings of 34 μm before used for the intermediate layer coating liquid (2).

| Formulation of intermediate layer coating liquid (2) | |
|---|---|
| Hollow particles dispersion A (shell of the hollow particles mainly includes a vinylidene chloride-acrylonitrile copolymer) | 28.6 |
| 10% polyvinyl alcohol aqueous solution (Polyvinyl alcohol: Kuraray Poval PVA617 manufactured by Kuraray Co., Ltd.) | 60 |
| Water | 31.4 |

The intermediate layer coating liquid (2) was coated on a paper sheet having a weight of 157 g/m$^2$ (Tradenamed as OK Top Coat Paper manufactured by Oji Paper Co., Ltd.) with a wire bar whose wire has a diameter of 1.2 mm, and dried at 100° C. for 3 minutes to form an intermediate layer having a thickness of 30 μm.

The paper having the intermediate layer was subjected to a calender treatment twice while applying a pressure of 30 mPa.

Formation of Dye Receiving Layer

The following components were mixed such that the resin dissolved in the mixture solvent.

| Formulation of dye receiving layer coating liquid | |
|---|---|
| Polyvinyl acetal resin (Tradenamed as KS-1 manufactured by Sekisui Chemical Co., Ltd.) | 4.7 |
| Toluene | 21.4 |
| Methyl ethyl ketone | 64.3 |

Thus, a dye receiving layer coating liquid was prepared.

The dye receiving layer coating liquid was coated on the intermediate layer with a wire bar, and dried to form an image receiving layer having a thickness of 5 μm.

Formation of Release Layer

The following components were mixed such that the resins were dissolved in the solvent.

| Formulation of release layer coating liquid | |
|---|---|
| Silicone resin (Tradenamed as SR2411 manufactured by Toray Silicone Industries, Inc.) | 16.65 |
| Acryl-silicone block copolymer (Tradenamed as LDL500 manufactured by Natoco Paint Co., Ltd.) | 0.37 |
| 2-propanol | 85.5 |

The release layer coating liquid was coated on the dye receiving layer, dried to form a release layer, and then aged for 12 hours at 60° C.

Thus, an image receiving material of Example 5 useful for n-speed mode multiple sublimation thermal transfer recording was prepared.

Example 6

The procedure for preparation of the image receiving material of Example 5 was repeated except that the formulation of the intermediate layer coating liquid was changed to the following formulation:

| Formulation of intermediate layer coating liquid | |
|---|---|
| Hollow particles dispersion B (shell of the hollow particles mainly includes a vinylidene chloride-acrylonitrile copolymer) | 37.0 |
| 10% polyvinyl alcohol aqueous solution (Polyvinyl alcohol: Kuraray Poval PVA617 manufactured by Kuraray Co., Ltd.) | 60 |
| Water | 23.0 |

The physical properties of hollow particles B are shown in Table 1. Hollow particles B had also been filtered by the metal sieve having openings of 32 μm before used for the intermediate layer coating liquid.

Thus, an image receiving material of Example 6 useful for n-fold speed mode multiple sublimation thermal transfer recording was prepared.

Example 7

The procedure for preparation of the image receiving material of Example 5 was repeated except that the formu lation of the intermediate layer coating liquid was changed to the following formulation:

| Formulation of intermediate layer coating liquid | |
|---|---|
| Hollow particles dispersion C (shell of the hollow particles mainly includes a vinylidene chloride-acrylonitrile copolymer) | 33.5 |
| 10% polyvinyl alcohol aqueous solution (Polyvinyl alcohol: Kuraray Poval PVA617 manufactured by Kuraray Co., Ltd.) | 60 |
| Water | 26.5 |

The physical properties of hollow particles C are shown in Table 1. Hollow particles C had also been filtered by the metal sieve having openings of 28 μm before used for the intermediate layer coating liquid.

Thus, an image receiving material of Example 7 useful for n-fold speed mode multiple sublimation thermal transfer recording was prepared.

Example 8

The procedure for preparation of the image receiving material of Example 5 was repeated except that the formulation of the intermediate layer coating liquid was changed to the following formulation:

| Formulation of intermediate layer coating liquid | |
|---|---|
| Hollow particles dispersion D (shell of the hollow particles mainly includes a vinylidene chloride-acrylonitrile copolymer) | 19.5 |
| 10% polyvinyl alcohol aqueous solution (Polyvinyl alcohol: Kuraray Poval PVA617 manufactured by Kuraray Co., Ltd.) | 60 |
| Water | 40.5 |

The physical properties of hollow particles D are shown in Table 1. Hollow particles D had also been filtered by the metal sieve having openings of 26 μm before used for the intermediate layer coating liquid.

Thus, an image receiving material of Example 8 useful for n-fold speed mode multiple sublimation thermal transfer recording was prepared.

Comparative Examples 5 to 8

The procedure of preparation of the image receiving material of Example 5, 6, 7 or 8 was repeated to prepare except that hollow particles A, B, C or D had not been filtered. Therefore the coating liquids included large hollow particles. The maximum diameter of the hollow particles are shown in Table 1.

Thus, image receiving materials of Comparative Examples 5 to 8 for n-fold speed mode multiple sublimation thermal transfer recording were prepared.

Preparation of Sublimation Thermal Transfer Recording Material for n-fold Speed Mode Multiple Thermal Transfer Recording Formation of Adhesive Layer The following components were mixed such that the polyvinyl butyral resin dissolved in the mixture solvent.

| Formulation of adhesive layer coating liquid | |
|---|---|
| Polyvinyl butyral resin (Tradenamed as BX-1 manufactured by Sekisui Chemical Co., Ltd.) | 10 |
| Isocyanate compound (Tradenamed as Coronate L manufactured by Nippon Polyurethane Industry Co., Ltd.) | 5 |
| Toluene | 95 |
| Methyl ethyl ketone | 95 |

Thus an adhesive layer coating liquid was prepared.

The adhesive layer coating liquid was coated with a wire bar on one side of an aromatic polyamide film having a thickness of 6 μm, dried at 100° C. for 90 seconds, and then aged for 12 hours at 60° C. to form an adhesive layer of 1 μm thick. At this point, on the opposite side of the polyethylene terephthalate film, a backcoat layer having a thickness of μm and consisting of a silicone resin had been formed.

Formation of Dye Supplying Layer

The following components were mixed such that the polyvinyl butyral resin was dissolved in the mixture solvent.

| Formulation of dye supplying layer coating liquid | |
|---|---|
| Polyvinyl butyral (Tradenamed as BX-1 manufactured by Sekisui Chemical Co., Ltd.) | 10 |
| Isocyanate compound (Tradenamed as Coronate L manufactured by Nippon Polyurethane Industry Co., Ltd.) | 5 |
| Sublimation dye (Tradenamed as R-3 manufactured by Nippon Kayaku Co., Ltd.) | 5 |
| Ethanol | 180 |
| n-butanol | 10 |

Thus a dye supplying layer coating liquid was prepared.

The dye supplying layer coating liquid was coated with a wire bar on the adhesive layer, and dried at 100° C. for 90 seconds to form a dye supplying layer having a thickness of 3 μm.

Formation of Dye Transferring Layer

The following components were mixed such that the polyvinyl butyral resin was dissolved in the mixture solvent.

| Formulation of dye transferring layer coating liquid | |
|---|---|
| Polyvinyl butyral (Tradenamed as BX-1 manufactured by Sekisui Chemical Co., Ltd.) | 10 |
| Isocyanate compound (Tradenamed as Coronate L manufactured by Nippon Polyurethane Industry Co., Ltd.) | 5 |
| Sublimation dye (Tradenamed as R-3 manufactured by Nippon Kayaku Co., Ltd.) | 5 |
| Toluene | 95 |
| Methyl ethyl ketone | 95 |

Thus a dye transferring layer coating liquid was prepared.

The dye transferring layer coating liquid was coated with a wire bar on the dye supplying layer, and dried at 100° C.

for 90 seconds to form a dye transferring layer having a thickness of 1 μm.

Formation of Low-dyeable Layer

The following components were mixed such that the styrene-maleic acid copolymer was dissolved in the mixture solvent.

| Formulation of low-dyeable layer coating liquid | |
|---|---|
| Styrene-maleic acid copolymer (Tradenamed as Suprapal AP-30 manufactured by BASF Ltd.) | 10 |
| Liquid B | 12 |
| Tetrahydrofuran | 20 |
| Methyl ethyl ketone | 95 |

Liquid B was prepared by dissolving 15 grams of dimethylmethoxysilane and 9 grams of methyltrimethoxysilane in a mixture solvent of 12 grams of toluene and 12 grams of methyl ethyl ketone; adding 3 grams of 3% sulfuric acid therein; and then hydrolyzing the mixture for 3 hours.

Thus a low-dyeable layer coating liquid was prepared.

The low-dyeable layer coating liquid was coated with a wire bar on the dye transferring layer, dried at 100° C. for 90 seconds, and then aged for 12 hours at 60° C. to form a low-dyeable layer having a thickness of 1 μm.

Thus a transfer material for n-fold multiple sublimation thermal transfer recording was prepared.

Evaluation Method

1. Image recording method (1) One-time sublimation thermal transfer recording

Each of the image receiving materials of Examples 1 to 4 and Comparative Examples 1 to 4 was overlaid with the sublimation thermal transfer recording material for one-time sublimation thermal transfer recording such that the image receiving layer of the receiving material contacted the ink layer of the recording material. Images were formed on each receiving material by imagewise heating the backcoat layer of the recording material using a thermal head. The printing conditions are as follows:

Thermal head: A plane-type thermal head in which heat elements are disposed on a plane away from the edge thereof manufactured by Kyocera Corp.

Maximum energy applied to thermal head: 1.67 mJ/dot

Feeding speed of receiving material: 8.0 mm/sec

Feeding speed of recording material: 8.0 mm/sec (2) n-fold speed mode multiple sublimation thermal transfer recording Each of the image receiving materials of Examples 5 to 8 and Comparative Examples 5 to 8 was overlaid with the sublimation thermal transfer recording material for n-fold speed mode multiple sublimation thermal transfer recording such that the release layer of the receiving material contacted the low-dyable layer of the recording material. Images were formed on each receiving material by imagewise heating the backcoat layer of the recording material using a thermal head. The printing conditions are as follows:

Thermal head:

1) A plane-type thermal head in which heat elements are disposed on a plane away from the edge thereof manufactured by Kyocera Corp.

2) An edge-type thermal head in which heat elements are disposed on an edge thereof manufactured by Kyocera Corp.

Maximum energy applied to thermal head: 2.21 mJ/dot

Feeding speed of receiving material: 8.0 mm/sec

Feeding speed of recording material: 0.8 mm/sec

The formed images were visually observed to determine whether there are white spots in the images. The images were classified as follows:

○: uniform images without white spots

Δ: images have some small white spots

×: images have medium white spots

××: images have many large white spots

In addition, the image area of each receiving material was observed using a microscope to determine whether there are broken hollow particles and undyed areas which are not dyed with the ink due to rough surface of the receiving material.

2. Method for measuring roughness of surface of receiving material

Ten-point mean roughness Rz of the surface of each receiving material was measured with a surface analyzer, SURFCODER SE-30K, and an analyzer, SURFCODER ANALYZER AY-41, both of which manufactured by Kosaka Laboratory Ltd.

The results are shown in Tables 2 and 3.

TABLE 2

| | Image qualities (one-time recording) | Ten-point mean roughness Rz of surface of receiving material (μm) | Observation of receiving material with microscope |
|---|---|---|---|
| Example 1 | Δ | 4.0 | Some broken hollow particles were observed |
| Example 2 | ○ | 3.6 | Some broken hollow particles were observed |
| Example 3 | ○ | 2.3 | Good |
| Example 4 | ○ | 2.1 | Good |
| Comparative Example 1 | X | 4.5 | Many broken hollow particles and undyed areas were observed |
| Comparative Example 2 | X | 5.0 | Many broken hollow particles and undyed areas were observed |
| Comparative Example 3 | XX | 6.5 | Many broken hollow particles and undyed areas were observed |
| Comparative Example 4 | XX | 6.8 | Many broken hollow particles and undyed areas were observed |

When the cross section of each receiving material on which images are formed was observed using a scanning electron microscope (SEM), large aggregates of hollow particles were observed in the intermediate layers of the receiving materials of Comparative Examples 3 and 4 in which large hollow particles were covered with hollow particles while they were adhering to each other.

TABLE 3

| | Image qualities (n-fold speed mode multiple recording) | | Ten-point | |
|---|---|---|---|---|
| | Plane-type thermal head | Edge-type thermal head | mean roughness Rz (μm) | Observation of receiving material with microscope |
| Example 5 | Δ | X | 4.0 | Some broken hollow particles were observed |
| Example 6 | Δ | Δ | 3.6 | Some broken hollow particles were observed |
| Example 7 | ○ | ○ | 2.3 | Good |
| Example 8 | ○ | ○ | 2.1 | Good |
| Comparative Example 5 | X | X | 4.5 | Many broken hollow particles and undyed areas were observed |
| Comparative Example 6 | X | XX | 5.0 | Many broken hollow particles and undyed areas were observed |
| Comparative Example 7 | XX | XX | 6.5 | Many broken hollow particles and undyed areas were observed |
| Comparative Example 8 | XX | XX | 6.8 | Many broken hollow particles and undyed areas were observed |

When the cross section of each receiving material on which images are formed was observed using a scanning electron microscope (SEM), large aggregates of hollow particles were observed in the intermediate layer of the receiving materials of Comparative Examples 7 and 8 in which large hollow particles were covered with hollow particles while they were adhering to each other.

As can be understood from Tables 2 and 3, the receiving materials of Examples 3, 4, 7 and 8 can produce good images. The image formed on the receiving material of Example 1 is slightly inferior to those of Examples 2 to 4 in image qualities, however the image was still acceptable. The receiving materials of Examples 5 and 6 are slightly inferior to those of Examples 7 and 8 in image qualities, however the image was still acceptable when the images are recorded with a plane-type thermal head.

When images are recorded with an edge-type thermal head, the image qualities of the images on the receiving materials of Example 5 are inferior to those on the receiving materials of Examples 7 and 8, and the image qualities of the images on the receiving materials of Example 6 are slightly inferior to those on the receiving materials of Examples 7 and 8.

Example 9

The procedure for preparation of the receiving material of Example 5 was repeated except that the intermediate layer coating liquid was replaced with the following coating liquid, and the thickness of the intermediate layer was 9 μm.

| Formulation of intermediate layer coating liquid | |
|---|---|
| Hollow particles dispersion (shell of the hollow particles mainly includes a vinylidene chloride-acrylonitrile copolymer, solid content of 20%, average hollow rate of 85%, volume average particle diameter of 5.1 μm, and maximum particle diameter of 12.5 μm) | 15 |
| 10% polyvinyl alcohol aqueous solution (Polyvinyl alcohol: Kuraray Poval PVA613 manufactured by Kuraray Co., Ltd.) | 70 |
| Water | 15 |

Thus, a receiving material of Example 9 was prepared.

Example 10

The procedure for preparation of the receiving material of Example 9 was repeated except that the thickness of the intermediate layer was 50 μm.

Thus, a receiving material of Example 10 was prepared.

Example 11

The procedure for preparation of the receiving material of Example 9 was repeated except that the thickness of the intermediate layer was 110 μm.

Thus, a receiving material of Example 11 was prepared.

Example 12

The procedure for preparation of the receiving material of Example 10 was repeated except that the thickness of the dye receiving layer was 15 μm.

Thus, a receiving material of Example 12 was prepared.

Example 13

The procedure for preparation of the receiving material of Example 10 was repeated except that the intermediate layer coating liquid was replaced with the following coating liquid.

| Formulation of intermediate layer coating liquid | |
|---|---|
| Hollow particles dispersion (shell of the hollow particles mainly includes a vinylidene chloride-acrylonitrile copolymer, solid content of 20%, average hollow rate of 40%, volume average particle diameter of 5.1 μm, and maximum particle diameter of 12.5 μm) | 15 |
| 10% polyvinyl alcohol aqueous solution (Polyvinyl alcohol: Kuraray Poval PVA613 manufactured by Kuraray Co., Ltd.) | 70 |
| Water | 15 |

Thus, a receiving material of Example 13 was prepared.

Example 14

The procedure for preparation of the receiving material of Example 10 was repeated except that the calender treatment was performed while the rollers were heated at 100° C.

Thus, a receiving material of Example 14 was prepared.

Example 15

The procedure for preparation of the receiving material of Example 9 was repeated except that the intermediate layer coating liquid was replaced with the following coating liquid.

| Formulation of intermediate layer coating liquid | |
|---|---|
| Hollow particles dispersion (shell of the hollow particles mainly includes a vinylidene chloride-acrylonitrile copolymer, solid content of 20%, average hollow rate of 85%, volume average particle diameter of 5.1 μm, and maximum particle diameter of 12.5 μm) | 35 |
| 10% polyvinyl alcohol aqueous solution (Polyvinyl alcohol: Kuraray Poval PVA613 manufactured by Kuraray Co., Ltd.) | 30 |
| Water | 35 |

Thus, a receiving material of Example 15 was prepared.

Example 16

The procedure for preparation of the receiving material of Example 9 was repeated except that the intermediate layer coating liquid was replaced with the following coating liquid.

| Formulation ot intermediate layer coating liquid | |
|---|---|
| Hollow particles dispersion (shell of the hollow particles mainly includes a vinylidene chloride-acrylonitrile copolymer, solid content of 20%, average hollow rate of 85%, volume average particle diameter of 5.1 μm, and maximum particle diameter of 12.5 μm) | 10 |
| 10% polyvinyl alcohol aqueous solution (Polyvinyl alcohol: Kuraray Poval PVA613 manufactured by Kuraray Co., Ltd.) | 90 |

Thus, a receiving material of Example 16 was prepared.

Example 17

The procedure for preparation of the receiving material of Example 9 was repeated except that the intermediate layer coating liquid was replaced with the following coating liquid.

| Formulation of intermediate layer coating liquid | |
|---|---|
| Hollow particles dispersion (shell of the hollow particles mainly includes a vinylidene chloride-acrylonitrile copolymer, solid content of 20%, average hollow rate of 93%, volume average particle diameter of 5.1 μm, and maximum particle diarneter of 15.0 μm) | 40 |
| Styrene-butadiene latex (Tradenamed as 0696 manufactured by Japan Synthetic Rubber Co., Ltd.) | 30 |
| 10% polyvinyl alcohol aqueous solution (Polyvinyl alcohol: Kuraray Poval PVA617 manufactured by Kuraray Co., Ltd.) | 16 |
| Water | 14 |

Thus, a receiving material of Example 17 was prepared.

Example 18

The following water barrier layer coating liquid was coated on a paper sheet having a weight of 157 g/m$^2$ (Tradenamed as OK Top Coat Paper manufactured by Oji Paper Co., Ltd.) with a wire bar, and dried to form a water barrier layer having a thickness of 5 μm.

| Formulation of water barrier layer coating liquid | |
|---|---|
| Vinyl chloride-vinyl acetate copolymer (Tradenamed as VYHH manufactured by Union Carbide Corp.) | 10 |
| Toluene | 25 |
| Methyl ethyl ketone | 65 |

The following intermediate layer coating liquid was coated on the water barrier layer and then dried to form an intermediate layer having a thickness of 30 μm.

| Formulation of intermediate layer coating liquid | |
|---|---|
| Hollow particles dispersion (shell of the hollow particles mainly includes a vinylidene chloride-acrylonitrile copolymer, solid content of 20%, average hollow rate of 93%, volume average particle diameter of 5.1 μm, and maximum particle diameter of 15.0 μm) | 35 |
| Styrene-butadiene latex (Tradenamed as 0696 manufactured by Japan Synthetic Rubber Co., Ltd.) | 29.2 |
| Water | 35.8 |

Then the following organic solvent barrier layer coating liquid was coated on the intermediate layer with a wire bar, and dried to form an organic solvent barrier layer having a thickness of 2 μm.

| Formulation of organic solvent barrier layer coating liquid | |
|---|---|
| Polyvinyl alcohol (Tradenamed as Kuraray Poval PVA203, manufactured by Kuraray Co., Ltd) | 30 |
| Water | 70 |

Then a dye receiving layer and a release layer were formed on the organic solvent barrier layer one by one in the same way as performed in Example 5.

Thus, a receiving material of Example 18 was prepared.

The thus prepared receiving materials of Examples 9 to 18 were evaluated by the following method.

(1) n-fold speed mode multiple sublimation thermal transfer recording

Each image receiving material was overlaid with the sublimation thermal transfer recording material for n-fold speed mode multiple sublimation thermal transfer recording such that the release layer of the receiving material contacted the low-dyeable layer of the recording material. Images were formed on each receiving material by image-wise heating the backcoat layer of the recording material using a thermal head. The printing conditions are as follows:

Thermal head: A plane-type thermal head in which heat elements are disposed on a plane away from the edge thereof manufactured by Kyocera Corp.

Maximum energy applied to thermal head: 2.21 mJ/dot

Feeding speed of receiving material: 8.0 mm/sec

Feeding speed of recording material: 0.8 mm/sec

The image density of the images was measured by a reflection densitometer. In addition, the images were visually observed to determine whether there are undesired images.

(1) Gloss of surface of receiving material

The gloss of surface of each recording material was measured with a gloss meter, HANDY GLOSSMETER PG-1M manufactured by NIPPON DENSHOKU CO., LTD.

The results are shown in Table 4

TABLE 4

| | Image density | Gloss (%) | Image qualities |
|---|---|---|---|
| Example 9 | 1.20 | 42 | good |
| Example 10 | 2.10 | 35 | good |
| Example 11 | 1.60 | 30 | good |
| Example 12 | 1.50 | 55 | good |
| Example 13 | 1.10 | 35 | good |
| Example 14 | 2.15 | 45 | good |
| Example 15 | 2.09 | 30 | Uneven image |
| Example 16 | 0.80 | 52 | good |
| Example 17 | 2.00 | 32 | good |
| Example 18 | 2.21 | 52 | good |

The receiving material of Example 15 produced an uneven image because cracks were formed in the intermediate layer.

Among the receiving materials in Table 4, the receiving materials having a gloss not less than 40% produced high quality images having a high gloss.

In addition, the intermediate layer coating liquid of Example 17 had a relatively good dispersing property compared to that of Example 1, and the hollow particles hardly separated in the coating liquid although the coating liquid mainly included an emulsion resin as a binder resin. This is because the coating liquid includes polyvinyl alcohol.

Further, when 0.9 parts of a fluorescent brightening agent (Tradenamed as Mikephor BE conc., manufactured by Mitsui Chemicals Inc.) was added to the intermediate layer coating liquid of Example 10, the whiteness of the receiving material increased. Therefore, the images formed on the receiving material looked as high class images and good image qualities.

As can be understood from the above description, by including hollow particles, each of which has a particle diameter not greater than 35 μm, and preferably not greater than 30 μm, in an intermediate layer of a receiving material, good images without white spots can be formed on the receiving material.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 11-145165, filed on May 25, 1999, the entire contents of which are herein incorporated by reference.

What is claimed is:

1. A thermal transfer image receiving material comprising a substrate, an intermediate layer which comprises hollow particles and a binder resin and which is formed overlying the substrate, and an image receiving layer which comprises a resin and which is formed overlying the intermediate layer, wherein an image is to be formed on a surface of said image receiving layer, and wherein each of the hollow particles in the intermediate layer has a particle diameter not greater than about 35 μm.

2. The receiving material according to claim 1, wherein each of the hollow particles has a particle diameter not greater than about 30 μm.

3. The receiving material according to claim 1, wherein the surface of the image receiving layer has a ten-point mean roughness Rz less than about 4.0 μm.

4. The receiving material according to claim 1, wherein the hollow particles have an average hollow rate not less than about 50%.

5. The receiving material according to claim 4, wherein the intermediate layer has a thickness of from about 10 μm to about 100 μm and the image receiving layer has a thickness of from about 1 μm to about 10 μm.

6. The receiving material according to claim 1, wherein the hollow particles have a volume average particle diameter not greater than about 10 μm.

7. The receiving material according to claim 1, wherein the surface of the image receiving layer has a gloss Gs(60°) not less than about 40%.

8. The receiving material according to claim 1, wherein a weight ratio of the hollow particles to a total of the hollow particles and the binder resin is from about 0.25 to about 0.60.

9. The receiving material according to claim 1, wherein the hollow particles have a shell on which an inorganic pigment is present.

10. The receiving material according to claim 1, wherein the hollow particles have a shell including a fluorescent brightening agent.

11. The receiving material according to claim 1, wherein the intermediate layer is formed by drying an aqueous liquid comprising the hollow particles, a water soluble resin and a resin emulsion.

12. The receiving material according to claim 1, wherein the image receiving material further comprises a water barrier layer which is formed between the substrate and the intermediate layer, and an organic solvent barrier layer which is formed between the intermediate layer and the image receiving layer.

13. The receiving material according to claim 1, wherein the image receiving layer comprises a dye receiving layer and a release layer formed overlying the dye receiving layer.

14. A thermal transfer recording method comprising the steps of:

feeding a thermal transfer recording material which comprises a substrate and an ink layer which is formed overlying one side of the substrate; and an image receiving material comprising a substrate, an intermediate layer which comprises hollow particles and a binder resin and which is formed overlying the substrate, and an image receiving layer which comprises a resin and which is formed overlying the intermediate layer, wherein each of the hollow particles in the intermediate layer has a particle diameter not greater than about 35 μm, and imagewise heating the recording material while the ink layer of the recording material contacts the image receiving layer of the receiving material, wherein the image receiving material is fed at a speed n times that of the recording material, wherein n is greater than 1.

15. A thermal transfer color image recording method comprising the steps of:

feeding plural thermal transfer recording materials each of which comprises a substrate and an ink layer which is formed overlying one side of the substrate, wherein each ink layer has a different color; and an image receiving material which comprises a substrate, an intermediate layer which comprises hollow particles and which is formed overlying the substrate, and an image receiving layer which comprises a resin and which is formed overlying the intermediate layer, wherein each of the hollow particles in the intermediate layer has a particle diameter not greater than about 35 μm; and imagewise heating the recording materials with respective thermal heads while the ink layer of each recording material contacts the image receiving layer to form color images on the image receiving layer and while the receiving material is fed at a speed greater than that of any of the recording materials.

16. The thermal transfer color image recording method of claim 15, wherein each of the thermal heads has heat elements on an edge thereof.

17. A thermal transfer color image recording method comprising the steps of:

feeding a thermal transfer recording material which comprises a substrate and plural ink layers having different colors which are formed side by side overlying one side of the substrate; and an image receiving material which comprises a resin and which is formed overlying the intermediate layer, wherein each of the hollow particles in the intermediate layer has a particle diameter not greater than about 35 μm;

imagewise heating one of ink layer of the recording material with a thermal head while the ink layer contacts the image receiving layer to form a dye image on the image receiving layer, wherein the receiving material is fed at a speed n times that of the recording material, wherein n is larger than 1; and repeating the imagewise heating using the other ink layer or ink layers with the thermal head to form a color image on the receiving material.

18. The thermal transfer color image recording method of claim 17, wherein the thermal head has heat elements on an edge thereof.

19. A thermal transfer color image recording method comprising the steps of:

feeding a thermal transfer recording material which comprises a substrate and plural ink layers having different colors which are formed side by side overlying one side of the substrate; and an image receiving material which comprises a substrate, an intermediate layer which comprises hollow particles and which is formed overlying the substrate, and an image receiving layer which comprises a resin and which is formed overlying the intermediate layer, wherein each of the hollow particles in the intermediate layer has a particle diameter not greater than about 35 μm; and imagewise heating the ink layers with respective thermal heads while the ink layers contacts the image receiving layer to form color images on the image receiving layer and while the receiving material is fed at a speed greater than that of the recording material.

20. The thermal transfer color image recording method of claim 19, wherein each of the thermal heads has heat elements on an edge thereof.

* * * * *